US007369038B1

(12) United States Patent
Thompson

(10) Patent No.: US 7,369,038 B1
(45) Date of Patent: May 6, 2008

(54) AUTOMATED DETECTION SYSTEM FOR SPORTS FIELDS AND THE LIKE

(76) Inventor: James F. Thompson, 2603 Watson Dr., Charlotte, NC (US) 28208

( * ) Notice: Subject to any disclaimer, the term of this patent is extended or adjusted under 35 U.S.C. 154(b) by 330 days.

(21) Appl. No.: 11/260,730

(22) Filed: Oct. 28, 2005

(51) Int. Cl.
*A63B 69/00* (2006.01)
*A63B 71/06* (2006.01)
*G07C 1/24* (2006.01)

(52) U.S. Cl. ..... 340/323 R; 340/665; 473/467; 473/415; 473/476

(58) Field of Classification Search ..... 340/573.1, 340/39 R, 665; 473/467, 415, 476, 479, 473/490
See application file for complete search history.

(56) References Cited

U.S. PATENT DOCUMENTS 4,365,805 A * 12/1982 Levine ..... 473/467
4,432,058 A 2/1984 Supran
4,840,377 A 6/1989 Bowser et al.
4,855,711 A 8/1989 Harrop et al.
4,859,986 A 8/1989 Van Auken et al.
5,672,128 A * 9/1997 Conn ..... 473/467
5,800,292 A 9/1998 Brace
5,954,599 A * 9/1999 Lin ..... 473/467

* cited by examiner

*Primary Examiner*—Benjamin C. Lee
*Assistant Examiner*—Travis Hunnings

(57) ABSTRACT

A computer monitoring system includes a processor and sensors electrically thereto that are positioned beneath the playing surface directly below a boundary line. The sensors are connected in series to the processor such that each sensor is independently activated and generates an analog output signal when a predetermined weight limit is detected thereon. The sensors are positioned below a three-point and a free-throw line. An analog-to-digital converter is coupled to the processor and sensors that receives and converts the analog signals to digital signals. A memory includes programmable software instruction that cause the system to perform a series of operations. The processor generates and transmits audible and visual notification signals for each of the consecutive digital signals when the time span is greater than the threshold interval.

9 Claims, 2 Drawing Sheets

AUTOMATED DETECTION SYSTEM FOR SPORTS FIELDS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to detection systems and, more particularly, to an automated detection system for sports fields and the like.

2. Prior Art

In basketball, like many other sporting events having boundaries of play, judgment calls must be made continually as to whether events have taken place "in" or "out" of the boundary. Since the game play occurs at a rather rapid speed and the basketball is often obscured by the player's body, such judgment calls are extremely difficult because of the inherent inability of the human eye to follow an object moving at such a speed, and relate the relative position of impact on or over a line.

Prior to this time, a number of devices have been proposed which replace human judgment with a mechanical or optical sensor. The shortcomings of these devices, however, have prevented the widespread acceptance of any of these devices. Many of the previous devices require modification of the ball to plot its position relative to electrical conductors provided beneath the court and or its boundaries. This may be unacceptable in regulation play, and greatly increases the cost of basketballs and of modifying existing courts.

A second type of device is one which is laid on the playing surface and senses the impact of the ball or player on the critical boundary. These sensors are made of materials that are not well suited to withstand the strain of multiple impacts over a long period of time. One example shows a pressure switch, known as a "membrane" switch, which is comprised of foil conductors separated by a dielectric with holes. The weight of the impact presses the foil together within holes formed in the dielectric material.

The switches depend on plastic deformation of the conductors. Repeated deformations of this type, particularly under heavy pressure, tend to stretch the conductors, which over time may cause an electrical failure. Typically, the onset of failure is indicated by intermittent or multiple switching contacts per actual impact on the sensing device. This unreliability over time is unacceptable. Finally, a serious problem is "shadowing." This is the masking of one impact by another. For example, if a foot is already on the line when the ball hits, the sensor must be able to still detect the second impact, even if the two events are quite close together or simultaneous.

Accordingly, a need remains for an automated detection system for sports fields and the like in order to overcome the above-noted shortcomings. The present invention satisfies such a need by providing a detection system that is automatic in design, provides accurate pressure measurements and allows for improved flow and regulation of a game. Such a system automatically detects if a basketball player's foot or the basketball itself has touched the sideline or end-line markings of a basketball court. This allows game officials to referee a game more accurately, as well as reduce the instances of incorrect calls, which results in a more fair and balanced game between the opposing teams. Such a system thus also reduces the frequency of debates and heated arguments between players, coaches and the officials regarding questionable calls. The detection system can easily be incorporated to assist referees in sports other than basketball, like baseball, football and tennis, to name a few.

BRIEF SUMMARY OF THE INVENTION

In view of the foregoing background, it is therefore an object of the present invention to provide an automated detection system for sports fields and the like. These and other objects, features, and advantages of the invention are provided by a computer monitoring system for notifying a referee when a player or associated sports ball has passed beyond a predetermined boundary line defined on a playing surface.

The computer monitoring system includes a processor and a plurality of sensors electrically coupled to the processor. Such sensors are selectively positioned beneath the playing surface and are registered directly below the predetermined boundary line. The sensors are connected in parallel to the processor such that each sensor is advantageously and effectively independently activated during game playing conditions. Each sensor generates an analog output signal when a predetermined weight limit is detected thereon during game play. Such sensors are positioned directly below a three-point line and a free-throw line defined on the playing surface. An analog-to-digital converter is electrically coupled to the processor and the sensors. Such a converter receives and converts the analog output signals to digital output signals.

The present invention also includes a memory including programmable software instruction that cause the computer monitoring system to perform a series of operations. Such operations include the steps of determining an originating location of the digital output signals, determining a sequential order of the digital output signals, calculating a time span between consecutive digital output signals, and determining whether the time span is greater than a predetermined threshold interval. The processor generates and transmits audible and visual notification signals for each of the consecutive digital output signals when the time span is greater than the threshold interval. A later one of the consecutive digital output signals is ignored by the processor when the time span is less than the threshold interval.

The system preferably further includes a plurality of housings that are removably nested within a notch formed in the playing surface. Such housings are detachable from the playing surface and seated subjacent to the sensors for effectively and conveniently providing a rigid bottom surface against which the sensors are supported.

The system may also include a display screen electrically coupled to the processor. A graphical user interface is installed on the display screen. A speaker and an illuminable light source are electrically coupled to the processor and the display monitor. The graphical user interface conveniently provides a virtual image of the playing surface on the display screen and highlights an area of the playing surface when a selected one of the sensors detects the weight thereon such that the referee can advantageously quickly and effectively identify which boundary a player touched. The speaker and the illuminable light source receive the audible and visual notification signals when time span is greater than the predetermined time interval.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
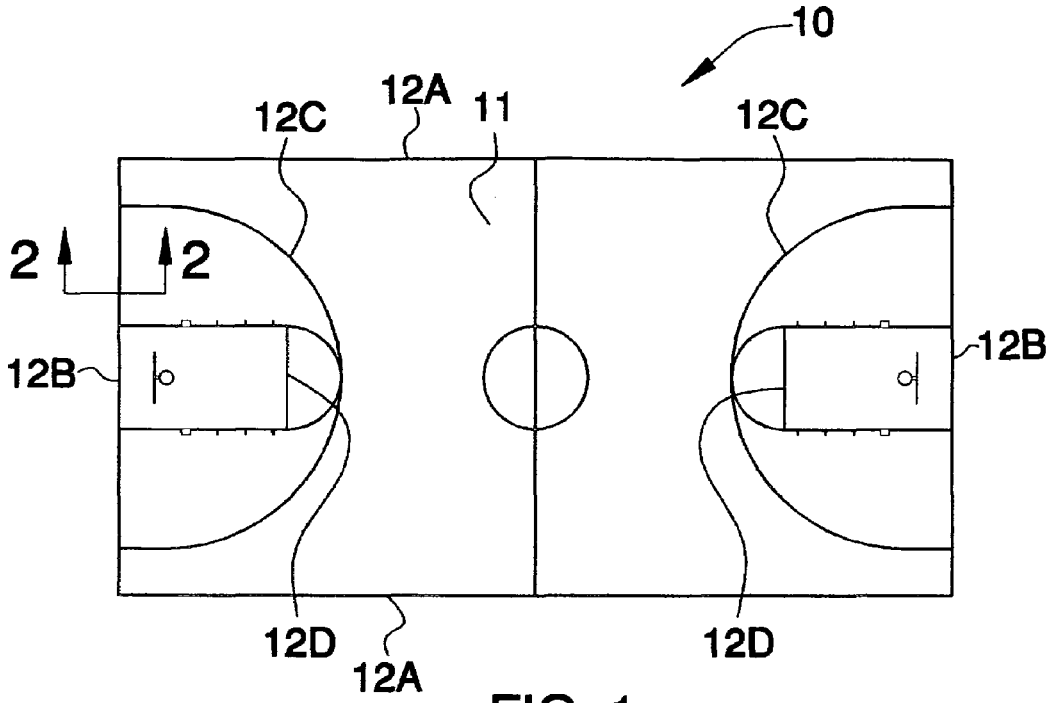
FIG. 1 is a top plan view showing a basketball court for employing an automated detection system for sports fields and the like, in accordance with the present invention.
Figure 2:
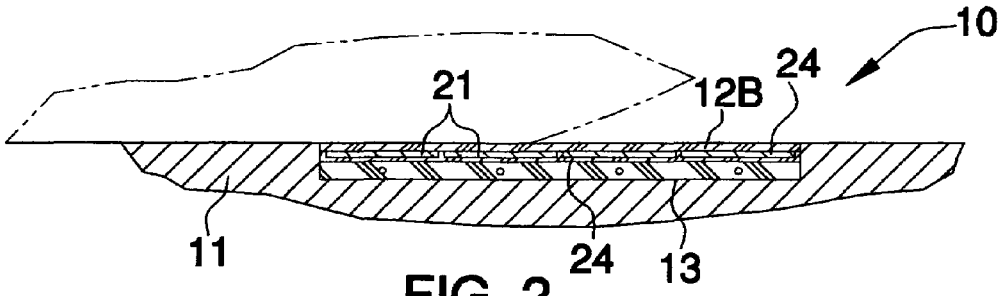
FIG. 2 is a cross-sectional view of the end-line shown in FIG. 1, taken along line 2-2, and showing the sensor positioned beneath the end-line.
Figure 3:
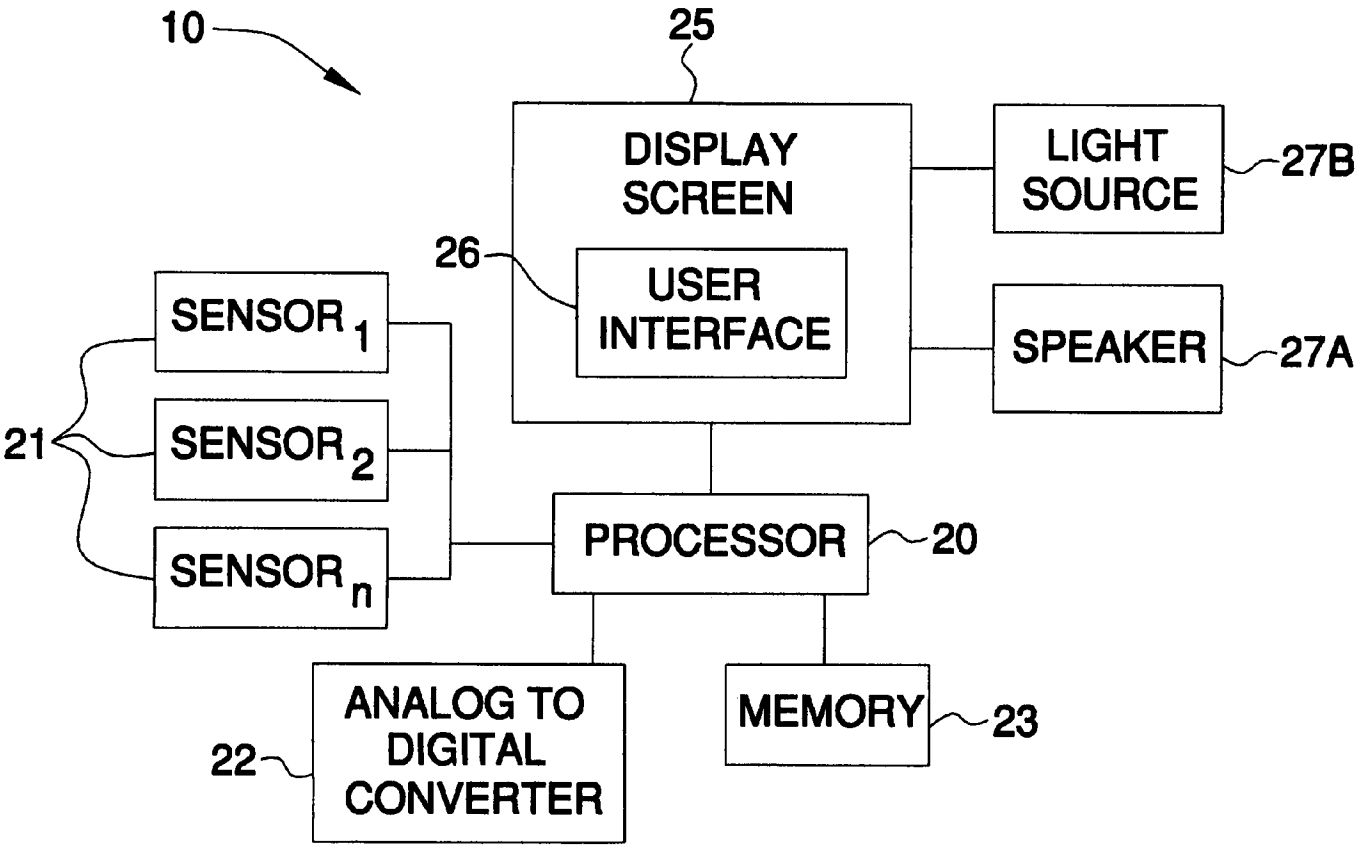
FIG. 3 is a schematic block diagram of the automated detection system, in accordance with the present invention.

The system of this invention is referred to generally in FIGS. 1-3 by the reference numeral 10 and is intended to provide an automated detection system for sports fields and the like. It should be understood that the system 10 may be used to detect player and ball movements in many different types of sports and should not be limited in use to only detecting such motions on basketball courts.

Referring initially to FIGS. 2 and 3, the system 10 includes a processor 20 and a plurality of sensors 21 electrically coupled to the processor 20. Such sensors 21 are selectively positioned beneath the playing surface 11 and are registered directly below the predetermined boundary line 12. The sensors 21 are connected in parallel to the processor 20, which is essential and advantageous such that each sensor 21 is effectively independently activated during game playing conditions. Each sensor 21 generates an analog output signal when a predetermined weight limit is detected thereon during game play.

Such sensors 21 are positioned directly below, without the use of intervening elements, a side boundary line 12A, end boundary line 12B, three-point boundary line 12C and a free-throw boundary line 12D defined on the playing surface 11. Of course, the sensors 21 may be placed beneath alternate boundary lines 12 of various different types of playing surfaces 11, such as football and soccer fields, and tennis courts, as is obvious to a person of ordinary skill in the art. An analog-to-digital converter 22 is electrically coupled to the processor 20 and the sensors 21. Such a converter is vital for receiving and converting the analog output signals to digital output signals.

Referring to FIG. 3, the present invention also includes a memory 23 including programmable software instructions that are important for causing the computer monitoring system 10 to perform a series of operations. Such operations include the steps of determining an originating location of the digital output signals, determining a sequential order of the digital output signals, calculating a time span between consecutive digital output signals, and determining whether the time span is greater than a predetermined threshold interval. The processor 20 generates and transmits audible and visual notification signals for each of the consecutive digital output signals when the time span is greater than the threshold interval. A later one of the consecutive digital output signals is ignored by the processor 20 when the time span is less than the threshold interval.

Referring to FIG. 2, the system 10 further includes a plurality of housings 24 that are removably nested within a notch 13 formed in the playing surface 11. Such housings 24 are detachable from the playing surface 11 and seated subjacent to the sensors 21, which is crucial for effectively and conveniently providing a rigid bottom surface against which the sensors 21 are supported. The housings 24 also serve to protect the sensors 21 from the repeated pressure forces experienced thereby during playing conditions, while advantageously still allowing the sensors 21 to detect when pressure is applied thereto.

Referring to FIG. 3, the system 10 also includes a display screen 25 electrically coupled to the processor 20. A graphical user interface 26 is installed on the display screen 25. A speaker 27A and an illuminable light source 27B are electrically coupled to the processor 20 and the display screen 25. The graphical user interface 26 provides a virtual image of the playing surface 11 on the display screen 25 and conveniently highlights an area of the playing surface 11 when a selected one of the sensors 21 detects the weight thereon, which is essential such that the referee can advantageously quickly and effectively identify which boundary 12 a player touched. This feature advantageously eliminates inherent human error due to slow reflexes and provides undisputable evidence that a player and/or the ball has traveled out of bounds.

Such a feature is not only applicable to basketball, but is also advantageous and useful in applications like tennis and volleyball, where it may be difficult to visually identify the exact location where the ball struck the playing surface 11, due to the high velocities at which the balls in those sports travel. The speaker 27A and the illuminable light source 27B receive the audible and visual notification signals when time span is greater than the predetermined time interval. Advantageously, having both an audible and a visual signal further increases the chances that the officiating staff will be notified when an out-of-bounds event has occurred. The visual notification is useful in loud settings where the sound of the crowd may cover that of the speaker and the audible notification is useful in a situation where the referee's attention can not always be fixed on the display screen 25.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A computer monitoring system for notifying a referee when a player or associated sports ball has passed beyond a predetermined boundary line defined on a playing surface, said computer monitoring system comprising:

a processor:

a plurality of sensors electrically coupled to said processor, said sensors being selectively positioned beneath the playing surface and registered directly below the predetermined boundary line, said sensors being connected in parallel to said processor such that each said sensor is independently activated during game playing conditions, each said sensor generating an analog output signal when a predetermined weight limit is detected thereon during game play;

an analog-to-digital converter electrically coupled to said processor and said sensors, said converter receiving and converting said analog output signals to digital output signals;

a memory including programmable software instruction that cause said computer monitoring system to perform a series of operations including the steps of:

a. determining an originating location of said digital output signals, b. determining a sequential order of said digital output signals, c. calculating a time span between consecutive digital output signals, and d. determining whether said time span is greater than a predetermined threshold interval;

wherein said processor generates and transmits audible and visual notification signals for each said consecutive digital output signals when said time span is greater than said threshold interval, a later one of said consecutive digital output signals being ignored by said processor when said time span is less than said threshold interval.

2. The system of claim 1, further comprising: a plurality of housings removably nested within a notch formed in the playing surface, said housings being detachable from the playing surface and seated subjacent said sensors for providing a rigid bottom surface against which said sensors are supported.

3. The system of claim 1, further comprising:

a display screen electrically coupled to said processor;

a graphical user interface installed on said display screen; and a speaker and an illuminable light source electrically coupled to said processor and said display monitor;

wherein said graphical user interface provides a virtual image of the playing surface on said display screen and highlights an area of the playing surface when a selected one of said sensors detects the weight thereon such that the referee can quickly and effectively identify which boundary a player touched, said speaker and said illuminable light source being receiving said audible and visual notification signals when time span is greater than the predetermined time interval.

4. A computer monitoring system for notifying a referee when a player or associated sports ball has passed beyond a predetermined boundary line defined on a playing surface, said computer monitoring system comprising:

a processor:

a plurality of sensors electrically coupled to said processor, said sensors being selectively positioned beneath the playing surface and registered directly below the predetermined boundary line, said sensors being connected in parallel to said processor such that each said sensor is independently activated during game playing conditions, each said sensor generating an analog output signal when a predetermined weight limit is detected thereon during game play, wherein said sensors are positioned directly below a three-point line defined on the playing surface;

an analog-to-digital converter electrically coupled to said processor and said sensors, said converter receiving and converting said analog output signals to digital output signals;

a memory including programmable software instruction that cause said computer monitoring system to perform a series of operations including the steps of:

a. determining an originating location of said digital output signals, b. determining a sequential order of said digital output signals, c. calculating a time span between consecutive digital output signals, and d. determining whether said time span is greater than a predetermined threshold interval;

wherein said processor generates and transmits audible and visual notification signals for each said consecutive digital output signals when said time span is greater than said threshold interval, a later one of said consecutive digital output signals being ignored by said processor when said time span is less than said threshold interval.

5. The system of claim 4, further comprising: a plurality of housings removably nested within a notch formed in the playing surface, said housings being detachable from the playing surface and seated subjacent said sensors for providing a rigid bottom surface against which said sensors are supported.

6. The system of claim 4, further comprising:

a display screen electrically coupled to said processor;

a graphical user interface installed on said display screen; and a speaker and an illuminable light source electrically coupled to said processor and said display monitor;

wherein said graphical user interface provides a virtual image of the playing surface on said display screen and highlights an area of the playing surface when a selected one of said sensors detects the weight thereon such that the referee can quickly and effectively identify which boundary a player touched, said speaker and said illuminable light source being receiving said audible and visual notification signals when time span is greater than the predetermined time interval.

7. A computer monitoring system for notifying a referee when a player or associated sports ball has passed beyond a predetermined boundary line defined on a playing surface, said computer monitoring system comprising:

a processor:

a plurality of sensors electrically coupled to said processor, said sensors being selectively positioned beneath the playing surface and registered directly below the predetermined boundary line, said sensors being connected in parallel to said processor such that each said sensor is independently activated during game playing conditions, each said sensor generating an analog output signal when a predetermined weight limit is detected thereon during game play, wherein said sensors are positioned directly below a three-point line defined on the playing surface, wherein said sensors are positioned directly below a free-throw line defined on the playing surface;

an analog-to-digital converter electrically coupled to said processor and said sensors, said converter receiving and converting said analog output signals to digital output signals;

a memory including programmable software instruction that cause said computer monitoring system to perform a series of operations including the steps of:

a. determining an originating location of said digital output signals, b. determining a sequential order of said digital output signals, c. calculating a time span between consecutive digital output signals, and d. determining whether said time span is greater than a predetermined threshold interval;

wherein said processor generates and transmits audible and visual notification signals for each said consecutive digital output signals when said time span is greater than said threshold interval, a later one of said consecutive digital output signals being ignored by said processor when said time span is less than said threshold interval.

8. The system of claim 7, further comprising: a plurality of housings removably nested within a notch formed in the playing surface, said housings being detachable from the playing surface and seated subjacent said sensors for providing a rigid bottom surface against which said sensors are supported.

9. The system of claim 7, further comprising:

a display screen electrically coupled to said processor;

a graphical user interface installed on said display screen; and a speaker and an illuminable light source electrically coupled to said processor and said display monitor;

wherein said graphical user interface provides a virtual image of the playing surface on said display screen and highlights an area of the playing surface when a selected one of said sensors detects the weight thereon such that the referee can quickly and effectively identify which boundary a player touched, said speaker and said illuminable light source being receiving said audible and visual notification signals when time span is greater than the predetermined time interval.

* * * * *